US006806832B2

(12) United States Patent
Sato et al.

(10) Patent No.: US 6,806,832 B2
(45) Date of Patent: Oct. 19, 2004

(54) SURFACE-MOUNT TYPE ANTENNA AND ANTENNA APPARATUS

(75) Inventors: Akinori Sato, Kyoto (JP); Takanori Ikuta, Kyoto (JP); Kazuo Watada, Kyoto (JP); Shunichi Murakawa, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/464,823

(22) Filed: Jun. 18, 2003

(65) Prior Publication Data

US 2004/0008141 A1 Jan. 15, 2004

(30) Foreign Application Priority Data

Jun. 19, 2002 (JP) ..... P2002-178425

(51) Int. Cl.[7] ..... H01Q 1/38; H01Q 1/24

(52) U.S. Cl. ..... 343/700 MS; 343/702; 343/895

(58) Field of Search ..... 343/700 MS, 702, 343/895

(56) References Cited

U.S. PATENT DOCUMENTS 5,748,149 A 5/1998 Kawahata ..... 343/700 MS
6,040,806 A * 3/2000 Kushihi et al. ..... 343/853
6,172,646 B1 * 1/2001 Kawahata et al. ..... 343/702

FOREIGN PATENT DOCUMENTS

JP 9-162633 6/1997

* cited by examiner

*Primary Examiner*—Michael C. Wimer
(74) *Attorney, Agent, or Firm*—Hogan & Hartson LLP

(57) ABSTRACT

In a surface-mount type antenna, a substantially-rectangular solid base body has a feeding terminal and a ground terminal formed on its one side surface. A radiating electrode has its one end connected to the ground terminal and is disposed helically across the surfaces of base body extending from one side surface to one principal surface. Another end of radiating electrode extends from one principal surface, through another side surface, toward another principal surface, to form a wide-area portion facing the feeding terminal. An antenna apparatus is constructed by mounting the surface-mount type antenna on a mounting substrate having formed thereon a feeding electrode, a ground electrode, and a ground conductor layer, and simultaneously connecting the feeding terminal and the ground terminal to the feeding electrode and the ground electrode, respectively.

11 Claims, 6 Drawing Sheets

SURFACE-MOUNT TYPE ANTENNA AND ANTENNA APPARATUS

BACKGROUND OF THE INVENTION

1. Field of the Invention

The present invention relates to a compact surface-mount type antenna and an antenna apparatus for use in mobile communication equipment such as a cellular phone.

2. Description of the Related Art

In keeping with rapid advancement of down-sized mobile communication equipment such as a cellular phone, miniaturization has been underway in an antenna which constitutes such equipment. Thus, for example, a surface-mount type antenna has hitherto been developed. Now, a conventional surface-mount type antenna and an antenna apparatus incorporating it will be described with reference to a perspective view shown in FIG. 8.

In FIG. 8, reference numeral 50 denotes a surface-mount type antenna. This surface-mount type antenna 50 is mounted on a mounting substrate 56, thus constituting an antenna apparatus 61. In the surface-mount type antenna 50 shown in FIG. 8, reference numeral 51 denotes a substantially prismatic base body; reference numeral 52 denotes a feeding terminal; reference numeral 53 denotes a ground terminal; and reference numeral 54 denotes a radiating electrode. Moreover, in the mounting substrate 56, reference numeral 57 denotes a substrate; reference numeral 58 denotes a feeding electrode; reference numeral 59 denotes a ground electrode; and reference numeral 60 denotes a ground conductor layer.

In the conventional surface-mount type antenna 50, the feeding terminal 52 and the ground terminal 53 are formed on a side surface of the base body 51. The radiating electrode 54, which is routed as a slim conductor pattern, is configured as follows. At first it extends upwardly from the ground terminal 53 on the side surface, and is then substantially U-shaped, as viewed plane-wise, on a top surface of the base body 51 so as to take substantially the form of a loop, and eventually returns to the side surface once again to extend downwardly toward the feeding terminal 52. Moreover, the radiating electrode 54 has a gap 55 formed in a certain position thereof close to the feeding terminal 52. Thereby, the capacitance of the radiating electrode 54 can be so adjusted that impedance matching is achieved between the radiating electrode 54 and the feeding electrode 58 (feeding line) of the mounting substrate 56.

On the other hand, in the mounting substrate 56, on a surface of the substrate 57 are formed the feeding electrode 58, the ground electrode 59, and the ground conductor layer 60. The ground conductor layer 60 is arranged on one side of the ground electrode 59 so as to be connected thereto.

Then, the surface-mount type antenna 50 is mounted, with the feeding terminal 52 connected to the feeding electrode 58 and the ground terminal 53 connected to the ground electrode 59, on the surface of the mounting substrate 56, thus constituting the antenna apparatus 61.

In the conventional surface-mount type antenna 50, however, since the radiating electrode 54 is made short, there is a tendency of an operating frequency to increase. To decrease the operating frequency, the base body 51 needs to have a higher dielectric constant, or the radiating electrode 54 needs to be slimmed down.

However, an increase in the dielectric constant of the base body 51 gives rise to a problem of the antenna characteristics being abruptly changed to narrow-band characteristics. On the other hand, slimming of the radiating electrode 54 gives rise to a problem of great radiation loss.

Moreover, by adjusting a size of the gap 55 which is formed in the radiating electrode 54 to achieve impedance matching between the radiating electrode 54 and the feeding electrode 58, the impedance of the radiating electrode 54 can be changed. In this case, however, a resonant frequency of the antenna varies with the change of the impedance. This makes it difficult to attain the desired antenna characteristics as designed.

SUMMARY OF THE INVENTION

The invention has been devised in view of the above-described problems with the conventional art, and accordingly its object is to provide a surface-mount type antenna and an antenna apparatus capable of attaining satisfactory antenna characteristics with stability, of enhancing radiation efficiency, and of achieving miniaturization.

The invention provides a surface-mount type antenna comprising:

- a base body made of a dielectric or magnetic material having a substantially rectangular solid shape;
- a feeding terminal formed at one end of one side surface of the base body;
- a ground terminal formed at another end of the one side surface of the base body;
- a radiating electrode which has its one end connected to the ground terminal, the radiating electrode being disposed helically across the surfaces of the base body in such a way that it extends from the one side surface, across one principal surface, another side surface which is opposite to the one side surface, and another principal surface which is opposite to the one principal surface, and then returns to the one side surface and further extends, through the one principal surface, toward the one end of the one side surface; and
- a wide-area portion,
- wherein another end of the radiating electrode extends from the one principal surface, through the other side surface, toward the other principal surface, so as to form the wide-area portion facing the feeding terminal.

According to the invention, the radiating electrode is disposed helically across the surfaces of the base body in such a way that it extends from the one side surface, across the one principal surface, the other side surface, and the other principal surface, and then returns to the one side surface and further extends, through the one principal surface, toward the one end of the one side surface, and further the other feeding-terminal-side end of the radiating electrode extends across the surfaces of the base body, i.e., extends from the one principal surface, through the other side surface, toward the other principal surface, so as to form the wide-area portion facing the feeding terminal. With this configuration, the radiating electrode can be made longer, and also the wide-area portion of the radiating electrode can be electro magnetically coupled to the feeding terminal through an electric capacitance generated therebetween. Moreover, at the time of mounting on the mounting substrate, since a large capacitance can be created between the wide-area portion of the radiating electrode and the ground conductor layer of the mounting substrate, the resonant frequency of the radiating electrode can be decreased. This makes it possible to achieve miniaturization of the antenna without increasing the dielectric constant of the base body and without excessively slenderizing the radiating electrode.

Further, according to the invention, the impedance matching between the radiating electrode and the feeding electrode (feeding line) of the mounting substrate on which the radiating electrode is mounted can be achieved by adjusting the capacitance between the radiating electrode and the feeding terminal. The capacitance adjustment can be made by adjusting the configuration and/or area of the wide-area portion of the radiating electrode. Meanwhile, a dominant factor in the magnitude of the resonant frequency of the antenna is the capacitance between the radiating electrode and the ground conductor layer of the mounting substrate. Hence, variation in the resonant frequency resulting from the impedance adjustment by means of the wide-area portion can be minimized. As a result, it is possible to obtain a compact surface-mount type antenna that provides higher radiation efficiency and stable antenna characteristics.

In the invention, it is preferable that a width of the wide-area portion is adjusted to be three to ten times that of a conductor portion of the radiating electrode having a helical conformation.

According to the invention, the capacitance between the wide-area portion and the feeding terminal or the ground conductor layer can be increased, thus achieving satisfactory electromagnetic coupling with the feeding terminal.

In the invention, it is preferable that a length of the wide-area portion which lies on the other principal surface of the base body, extending from the other side surface-side to the one side surface-side, is determined such that the distance to the one side surface is equal to or greater than 1 mm.

According to the invention, it is possible to prevent occurrence of frequency variation which is caused by capacitance variation between the wide-area portion and the ground conductor layer resulting from antenna-mounting positional variation.

In the invention, it is preferable that the base body is made of a dielectric material having a relative dielectric constant $\epsilon r$ which is kept within a range from 3 to 30.

According to the invention, an effective length of the radiating electrode is decreased, and thus the current distribution region is increased in area. This allows the radiating electrode to emit a larger quantity of radio waves, resulting in advantages in enhancing a gain of the antenna and in achieving miniaturization of the surface-mount type antenna.

In the invention, it is preferable that the base body is made of a magnetic material having a relative magnetic permeability $\mu r$ which is kept within a range from 1 to 8.

According to the invention, the radiating electrode has a higher impedance, which results in a low Q factor in the antenna, and the bandwidth is accordingly increased.

The invention further provides an antenna apparatus comprising:

a mounting substrate formed thereon a feeding electrode, a ground electrode, and a ground conductor layer which is connected to the ground electrode and arranged on one side of the mounting substrate with respect to the ground electrode; and the surface-mount type antenna of the invention as mentioned above, wherein the antenna apparatus is constructed by mounting the surface-mount type antenna on the mounting substrate, with its other principal surface arranged on another side of the mounting substrate with respect to the ground electrode, and simultaneously connecting the feeding terminal and the ground terminal to the feeding electrode and the ground electrode, respectively.

The invention still further provides an antenna apparatus comprising:

a mounting substrate formed thereon a feeding electrode, a ground electrode, and a ground conductor layer which is connected to the ground electrode and arranged on one side of the mounting substrate with respect to the ground electrode; and the surface-mount type antenna of the invention as mentioned above, wherein the antenna apparatus is constructed by mounting the surface-mount type antenna on the mounting substrate, with its one principal surface arranged on another side of the mounting substrate with respect to the ground electrode, and simultaneously connecting the feeding terminal and the ground terminal to the feeding electrode and the ground electrode, respectively.

According to the invention, the antenna apparatus is constructed as follows. The surface-mount type antenna of the invention is mounted on the mounting substrate formed thereon the feeding electrode, the ground electrode, and the ground conductor layer which is connected to the ground electrode and arranged on the one side of the mounting substrate with respect to the ground electrode. Simultaneously, the feeding terminal and the ground terminal are connected to the feeding electrode and the ground electrode, respectively. With this structure, by adjusting the capacitance created between the radiating electrode of the surface-mount type antenna having the wide-area portion and the feeding electrode, ground electrode, and ground conductor layer of the mounting substrate, impedance matching can be achieved between the radiating electrode and the feeding electrode. Moreover, proper setting and adjustment of the resonant frequency and radiation efficiency of the radiating electrode, as well as miniaturization, can be achieved with ease. As a result, it is possible to obtain a compact antenna apparatus that provides higher radiation efficiency and stable antenna characteristics.

In the invention, it is preferable that the surface-mount type antenna is mounted on the mounting substrate at a distance of 0.5 mm to 3 mm from an end of the ground conductor layer of the mounting substrate.

According to the invention, the antenna apparatus is operable at a frequency band of 1 GHz to 10 GHz.

In the invention, it is preferable that the surface-mount type antenna is so mounted as to protrude from an edge of the ground conductor layer.

According to the invention, the bandwidth and gain of the antenna can be enhanced.

As described heretofore, according to the invention, it is possible to provide a surface-mount type antenna and an antenna apparatus capable of attaining satisfactory antenna characteristics with stability, of enhancing radiation efficiency, and of achieving miniaturization.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
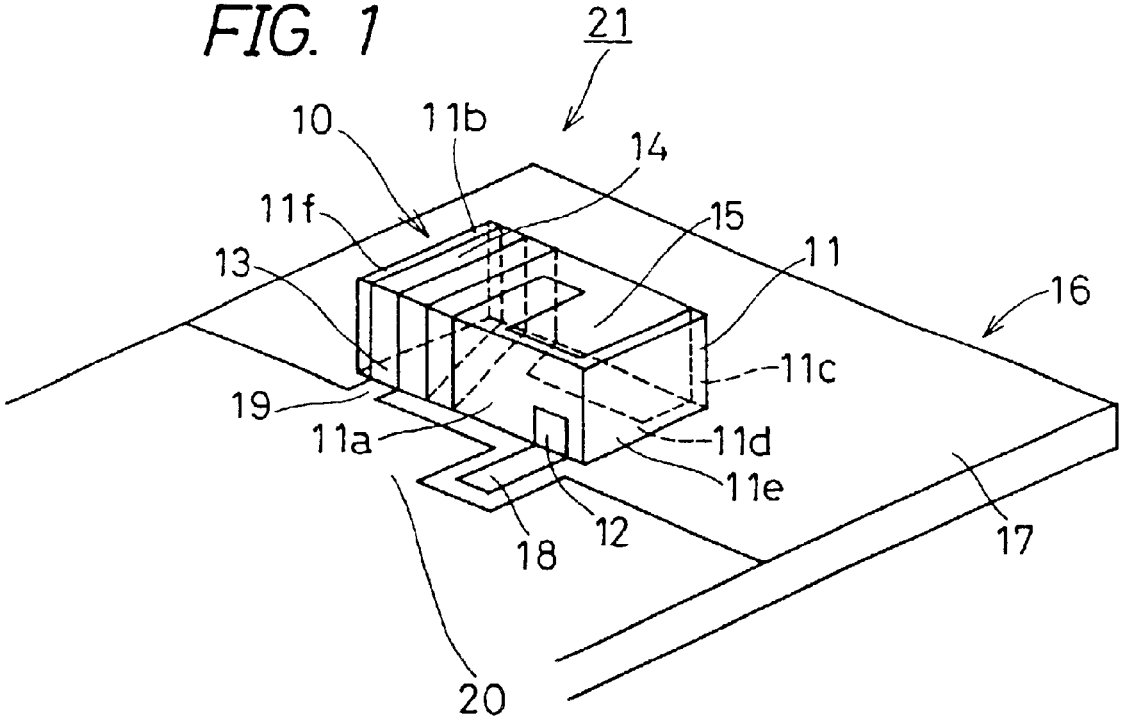
FIG. 1 is a perspective view showing a surface-mount type antenna of a first embodiment according to the invention, and also an antenna apparatus of a first embodiment according to the invention which is constituted by mounting the surface-mount type antenna on a surface of a mounting substrate.
Figure 2A:
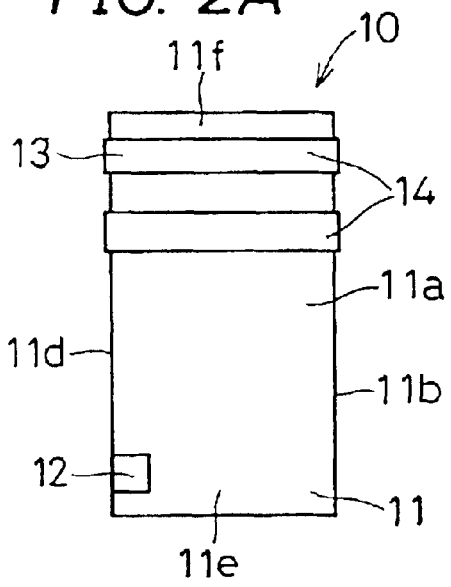
FIGS. 2A through 2D are plan views showing each of the principal and side surfaces of the surface-mount type antenna of the first embodiment according to the invention.
Figure 2B:
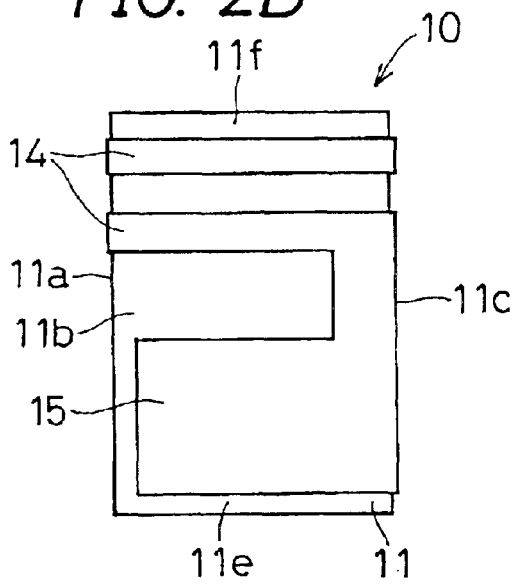
Figure 2C:
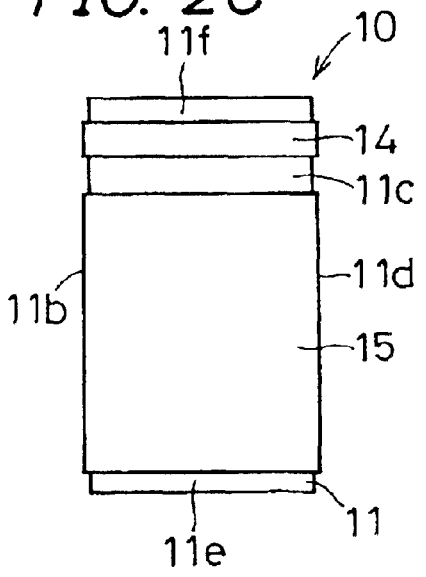
Figure 2D:
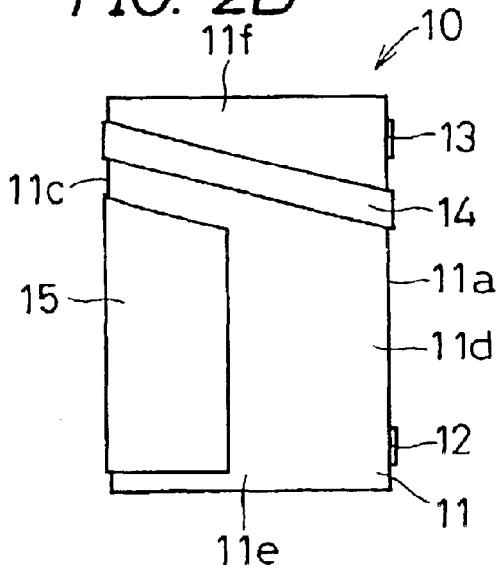

Now referring to the drawings, preferred embodiments of the invention are described below.

Figure 3:
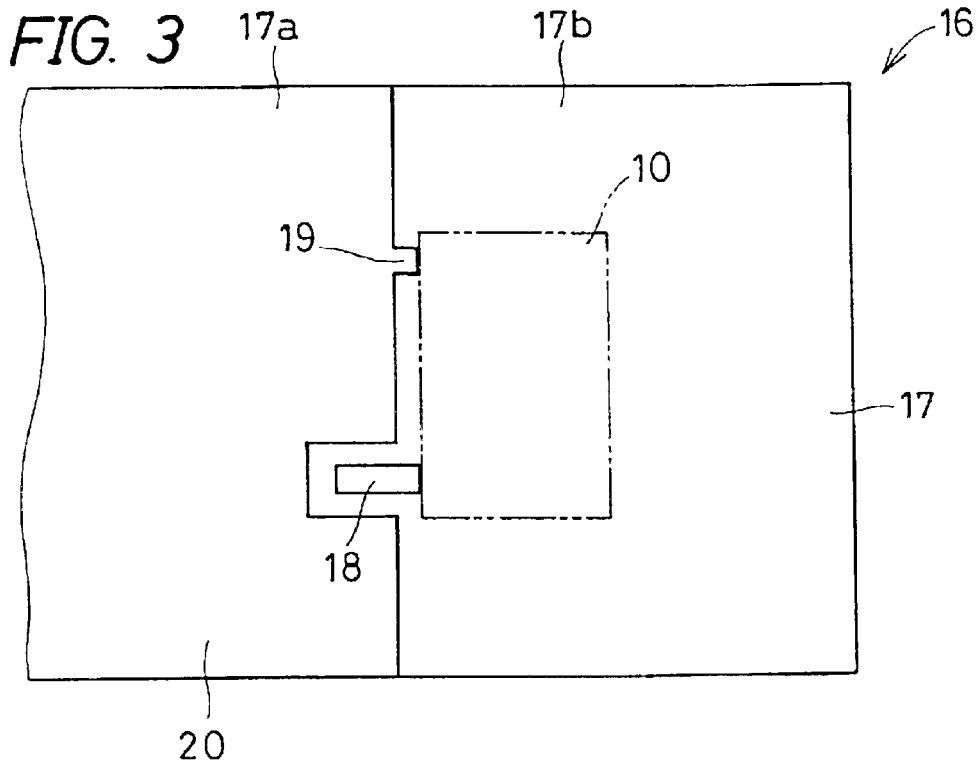
FIG. 3 is a plan view showing the mounting substrate.

FIG. 1 is a perspective view showing a surface-mount type antenna of a first embodiment according to the invention, and also an antenna apparatus of a first embodiment according to the invention which is constituted by mounting the surface-mount type antenna on a surface of a mounting substrate. FIGS. 2A through 2D are plan views showing each of the principal and side surfaces of the surface-mount type antenna of the first embodiment according to the invention. FIG. 3 is a plan view showing the mounting substrate.

In FIGS. 1 and 2A through 2D, reference numeral 10 denotes a surface-mount type antenna according to the invention; reference numeral 11 denotes a base body made of a dielectric or magnetic material having a substantially rectangular solid shape; reference numeral 12 denotes a feeding terminal formed at one end 11*e* of one side surface (corresponding to a left-hand front surface, in FIG. 1) 11*a* of the base body 11; reference numeral 13 denotes a ground terminal formed at another end 11*f* of the one side surface 11*a*; and reference numeral 14 denotes a radiating electrode which is formed of a line-shaped conductor. The radiating electrode 14 has its one end connected to the ground terminal 13, and is disposed helically across the surfaces of the base body 11. More specifically, the radiating electrode 14 extends from the one. side surface 11*a*, across one principal surface (corresponding to a top surface, in FIG. 1) 11*b* adjacent to the one side surface 11*a*; another side surface 11*c* which is opposite to the one side surface 11*a*; and another principal surface (corresponding to a bottom surface, in FIG. 1) 11*d* which is opposite to the one principal surface 11*b*, and then returns to the one side surface 11*a* and further extends, through the one principal surface 11*b*, toward the one end lie of the one side surface 11*a* (the feeding-terminal 12 side) In addition, reference numeral 15 denotes a wide-area portion formed at the other end of the radiating electrode 14.

Moreover, in FIGS. 1 and 3, reference numeral 16 denotes a mounting substrate; reference numeral 17 denotes a substrate; reference numeral 18 denotes a feeding electrode formed on the surface of the substrate 17; reference numeral 19 denotes aground electrode; and reference numeral 20 denotes a ground conductor layer which is connected to the ground electrode 19 and arranged on one side (corresponding to the left-hand front side, in FIG. 1) 17*a* of the substrate 17 with respect to the ground electrode 19.

That is, the surface-mount type antenna 10 according to the invention includes: the base body 11; the feeding terminal 12; the ground terminal 13; the radiating electrode 14; and the wide-area portion 15. The base body 11 is made of a dielectric or magnetic material having a substantially rectangular solid shape. The feeding terminal 12 is formed at the one end 11*e* of the one side surface 11*a* of the base body 11. The ground terminal 13 is formed at the other end 11*f* of the one side surface 11*a* of the base body 11. The radiating electrode 14, which is formed of a line-shaped conductor and has its one end connected to the ground terminal 13, is disposed helically across the surfaces of the base body 11 as follows. The radiating electrode 14 extends from the one side surface la, across the one principal surface 11*b*; the other side surface 11*c*; and the other principal surface 11*d*, and then returns to the one side surface 11*a* and further extends, through the one principal surface 11*b*, toward the one end 11*e* of the one side surface 11*a*. The wide-area portion 15 is formed at the other end of the radiating electrode 14.

Moreover, the mounting substrate 16 includes: the substrate 17; the feeding electrode 18; the ground electrode 19; and the ground conductor layer 20. The feeding electrode 18 is formed on the surface of the substrate 17. The ground electrode 19 is formed on the surface of the substrate 17. The ground conductor layer 20 is formed on the surface of the substrate 17. More specifically, the ground conductor layer 20 is connected to the ground electrode 19 and arranged on the one side 17*a* of the substrate 17 with respect to the ground electrode 19.

Then, the surface-mount type antenna 10 according to the invention is mounted on the surface of the mounting substrate 16, with its other principal surface 11*d* arranged on another side (corresponding to the right-hand rear side, in FIG. 1) 17*b* of the substrate 17 with respect to the ground electrode 19. Simultaneously, the feeding terminal 12 and the ground terminal 13 are connected to the feeding electrode 18 and the ground electrode 19, respectively. Thereupon, an antenna apparatus 21 of the first embodiment according to the invention is realized.

A remarkable feature of the surface-mount type antenna 10 according to the invention is that the other end of the radiating electrode 14 extends across the three surfaces of the base body 11, i.e., extends from the one principal surface 11*b*, through the other side surface 11*c*, toward the other principal surface lid, to form the wide-area portion 15 facing the feeding terminal 12.

Being disposed face to face with the feeding terminal 12 via the base body 11, the wide-area portion 15 of the radiating electrode 14 is electro magnetically coupled to the feeding terminal 12 through an electric capacitance generated therebetween. To increase the capacitance between the wide-area portion 15 of the radiating electrode 14 and the feeding terminal 12 or the ground conductor layer 20, the width of the wide-area portion 15 is adjusted to be three to ten times that of the slim conductor portion of the radiating electrode 14 having a helical conformation. Moreover, the length of the wide-area portion 15 which lies on the one principal surface 11*b* of the base body 11, extending from the other side surface 11*c*-side to the one side surface 11*a*-side, is determined such that the capacitance between the radiating electrode 14 and the feeding terminal 12 can be so adjusted as to achieve optimal impedance matching. Further, the length of the wide-area portion 15 which lies on the other principal surface lid of the base body 11, extending from the other side surface 11*c*-side to the one side surface 11*a*-side, is preferably determined such that the distance between the portion and the one side surface 11*a* is equal to or greater than 1 mm. This is because, since variation in capacitance between the wide-area portion 15 of the radiating electrode 14 and the ground conductor layer 20 leads to frequency variation, if the distance to the ground conductor layer 20 is unduly short, antenna-mounting positional variation may result, which causes frequency variation.

Then, the surface-mount type antenna 10 according to the invention thus constructed is mounted on the surface of the mounting substrate 16 at a distance of approximately 0.5 mm to 3 mm, for example, from the end of the ground conductor layer 20. Simultaneously, the ground terminal 13 is connected via the ground electrode 19 to the ground conductor layer 20. Thereupon, the antenna apparatus 21 of the first embodiment according to the invention is operable at a frequency band of approximately 1 GHz to 10 GHz, for example.

Figure 4:
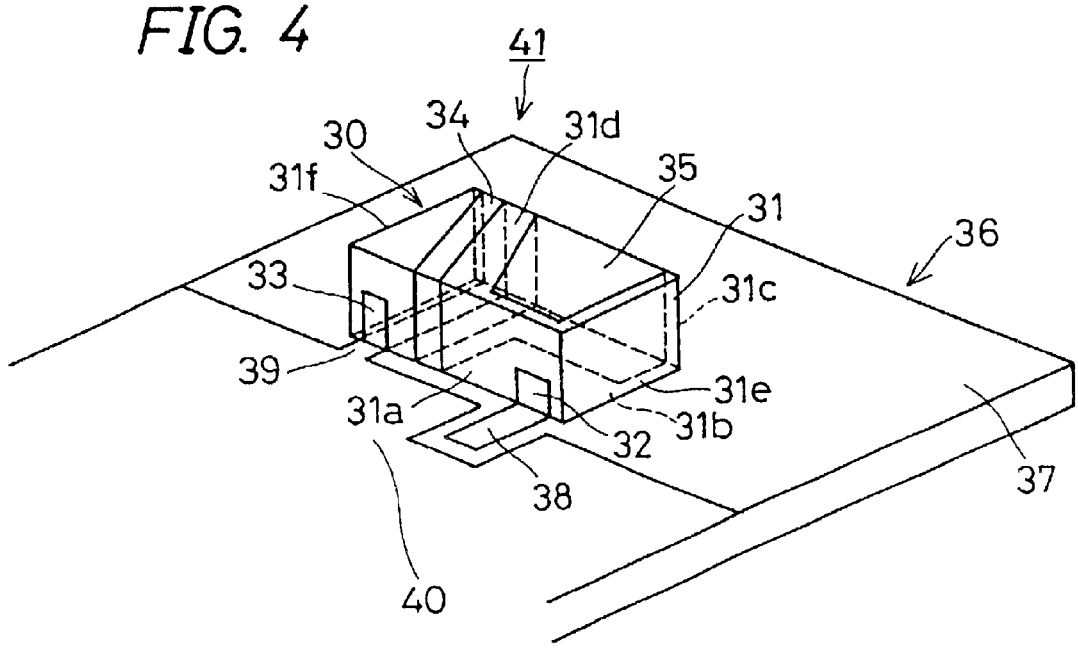
FIG. 4 is a perspective view showing an surface-mount type antenna of a second embodiment according to the invention, and also an antenna apparatus of a second embodiment according to the invention which is constituted by mounting the surface-mount type antenna on the surface of the mounting substrate.
Figure 5A:
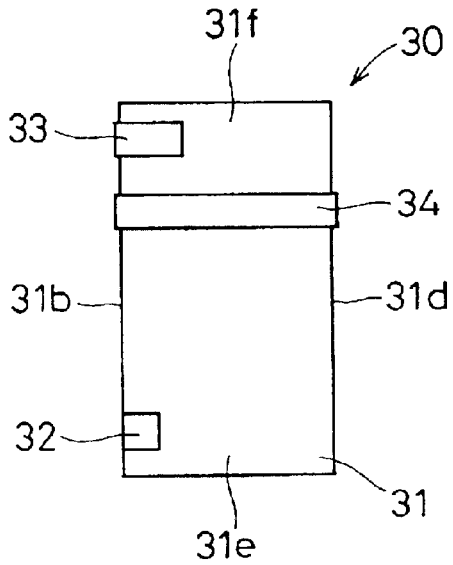
FIGS. 5A through 5D are plan views showing each of the principal and side surfaces of the surface-mount type antenna of the second embodiment according to the invention.
Figure 5B:
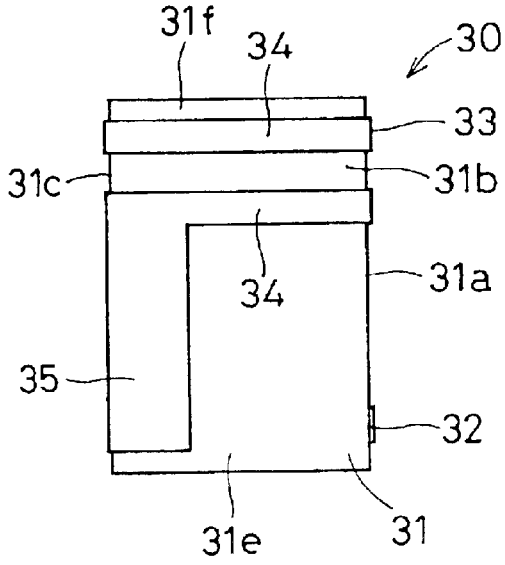
Figure 5C:
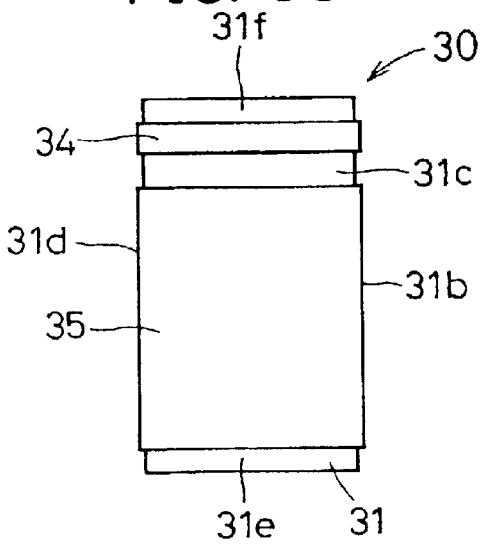
Figure 5D:
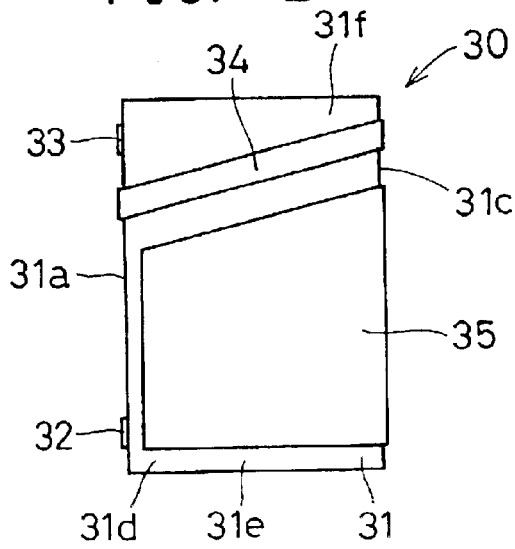
Figure 6:
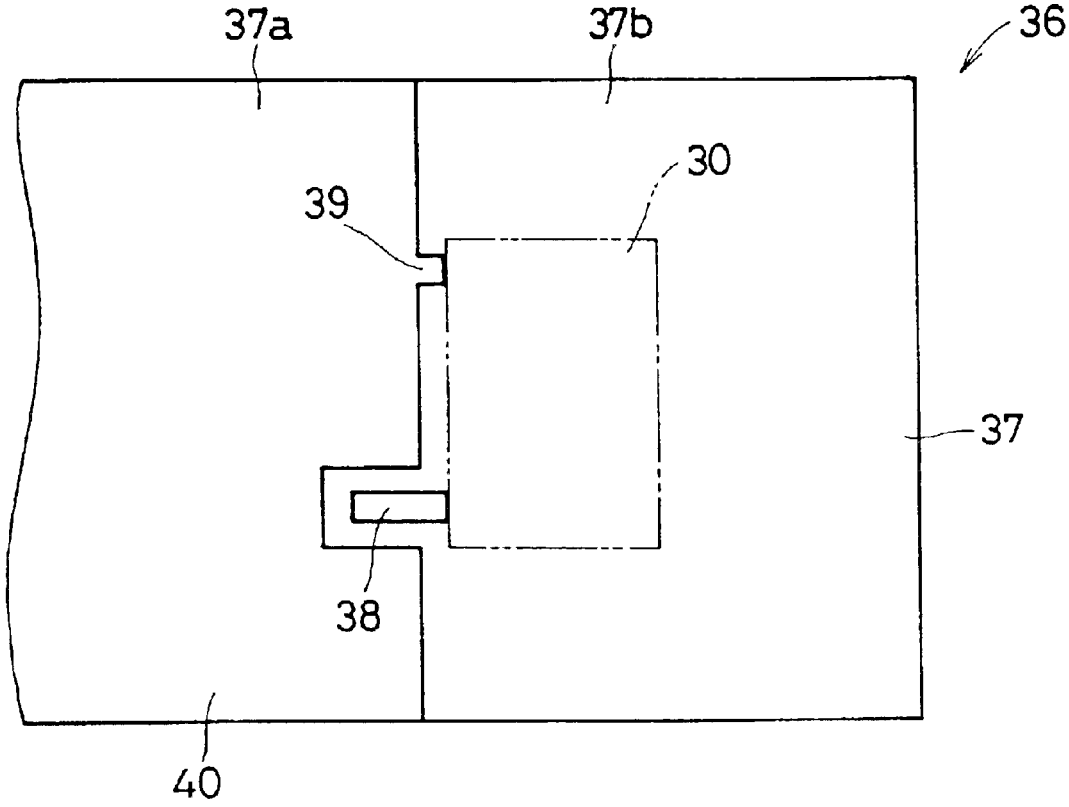
FIG. 6 is a plan view showing the mounting substrate.

FIG. 4 is a perspective view, alike to FIG. 1, showing an surface-mount type antenna of a second embodiment according to the invention, and also an antenna apparatus of a second embodiment according to the invention which is constituted by mounting the surface-mount type antenna on the surface of the mounting substrate. FIGS. 5A through 5D are plan views showing each of the principal and side surfaces of the surface-mount type antenna of the second embodiment according to the invention. FIG. 6 is a plan view showing the mounting substrate.

In FIGS. 4 and 5A through 5D, reference numeral 30 denotes a surface-mount type antenna according to the invention; reference numeral 31 denotes a base body made of a dielectric or magnetic material having a substantially rectangular solid shape; reference numeral 32 denotes a feeding terminal formed at one end 31*e* of one side surface (corresponding to a left-hand front surface, in FIG. 4) 31*a* of the base body 31; reference numeral 33 denotes a ground terminal formed at another end 31*f* of the one side surface 31*a*; and reference numeral 34 denotes a radiating electrode which is formed of a line-shaped conductor. The radiating electrode 34 has its one end connected to the ground terminal 33, and is disposed helically across the surfaces of the base body 31. More specifically, the radiating electrode 34 extends from the one side surface 31*a*, across one principal surface (corresponding to a bottom surface, in FIG. 4) 31*b* adjacent to the one side surface 31*a*; another side surface 31*c* which is opposite to the one side surface 31*a*; and another principal surface (corresponding to a top surface, in FIG. 4) 31*d* which is opposite to the one principal surface 31*b*, and then returns to the one side surface 31*a* and further extends, through the one principal surface 31*b*, toward the one end 31*e* of the one side surface 31*a* (the feeding-terminal 32 side). In addition, reference numeral 35 denotes a wide-area portion formed at the other end of the radiating electrode 34.

Moreover, in FIGS. 4 and 6, reference numeral 36 denotes a mounting substrate; reference numeral 37 denotes a substrate; reference numeral 38 denotes a feeding electrode formed on the surface of the substrate 37; reference numeral 39 denotes a ground electrode; and reference numeral 40 denotes a ground conductor layer which is connected to the ground electrode 39 and arranged on one side (corresponding to the left-hand front side, in FIG. 4) 37*a* of the substrate 37 with respect to the ground electrode 39.

That is, the surface-mount type antenna 30 according to the invention includes: the base body 31; the feeding terminal 32; the ground terminal 33; the radiating electrode 34; and the wide-area portion 35. The base body 31 is made of a dielectric or magnetic material having a substantially rectangular solid shape. The feeding terminal 32 is formed at the one end 31*e* of the one side surface 31*a* of the base body 31. The ground terminal 33 is formed at the other end 31*f* of the one side surface 31*a* of the base body 31. The radiating electrode 34, which is formed of a line-shaped conductor and has its one end connected to the ground terminal 33, is disposed helically across the surfaces of the base body 31 as follows. The radiating electrode 34 extends from the one side surface 31*a*, across the one principal surface 31*b*; the other side surface 31*c*; and the other principal surface 31*d*, and then returns to the one side surface 31*a* and further extends, through the one principal surface 31*b*, toward the one end 31*e* of the one side surface 31*a*. The wide-area portion 35 is formed at the other end of the radiating electrode 34.

Moreover, the mounting substrate 36 includes: the substrate 37; the feeding electrode 38; the ground electrode 39; and the ground conductor layer 40. The feeding electrode 38 is formed on the surface of the substrate 37. The ground electrode 39 is formed on the surface of the substrate 37. The ground conductor layer 40 is formed on the surface of the substrate 37. More specifically, the ground conductor layer 40 is connected to the ground electrode 39 and arranged on the one side 37*a* of the substrate 37 with respect to the ground electrode 39.

Then, the surface-mount type antenna 30 according to the invention is mounted on the surface of the mounting substrate 36, with its one principal surface 31*b* arranged on another side (corresponding to the right-hand rear side, in FIG. 4) 37*b* of the substrate 37 with respect to the ground electrode 39. Simultaneously, the feeding terminal 32 and the ground terminal 33 are connected to the feeding electrode 38 and the ground electrode 39, respectively. Thereupon, an antenna apparatus 41 of the second embodiment according to the invention is realized.

Also in the antenna apparatus 41 of the invention, a remarkable feature of the surface-mount type antenna 30 of the invention is that the other end of the radiating electrode 34 extends across the three surfaces of the base body 31, i.e., extends from the one principal surface 31*b*, through the other side surface 31*c*, toward the other principal surface 31*d*, to form the wide-area portion 35 facing the feeding terminal 32. The wide-area portion 35 is constructed basically in the same manner as the wide-area portion 15 in the surface-mount type antenna 10 of the invention shown in FIG. 1.

In the antenna apparatus 41 of the invention, the surface-mount type antenna 30 of the invention has basically the same structure as the surface-mount type antenna 10 of the invention shown in FIG. 1, the difference being the orientation of the helical conformation of the radiating electrode 34. Just as is the case with the antenna apparatus 21 of the invention, the surface-mount type antenna 30 of the invention is mounted on the surface of the mounting substrate 36 at a distance of approximately 0.5 mm to 3 mm, for example, from the end of the ground conductor layer 40. Simultaneously, the ground terminal 33 is connected via the ground electrode 39 to the ground conductor layer 40. Thereupon, the antenna apparatus 41 is operable at a frequency band of approximately 1 GHz to 10 GHz, for example.

With reference to the schematic equivalent circuit diagram shown in FIG. 7, a description will be given below as to a function of the antenna structure in the surface-mount type antenna 10, 30 and the antenna apparatus 21, 41.

Figure 7:
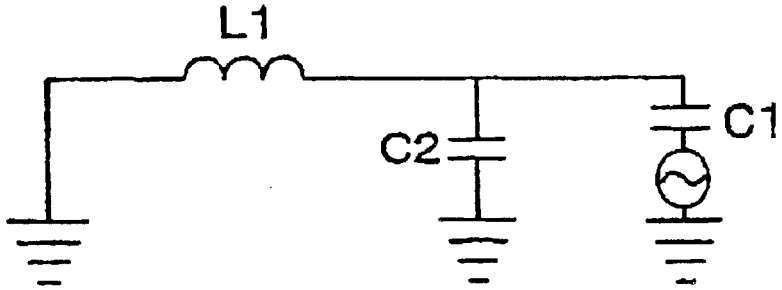
FIG. 7 is a schematic equivalent circuit diagram for explaining a function of the antenna structure in the surface-mount type antenna and the antenna apparatus according to the invention.
Figure 8:
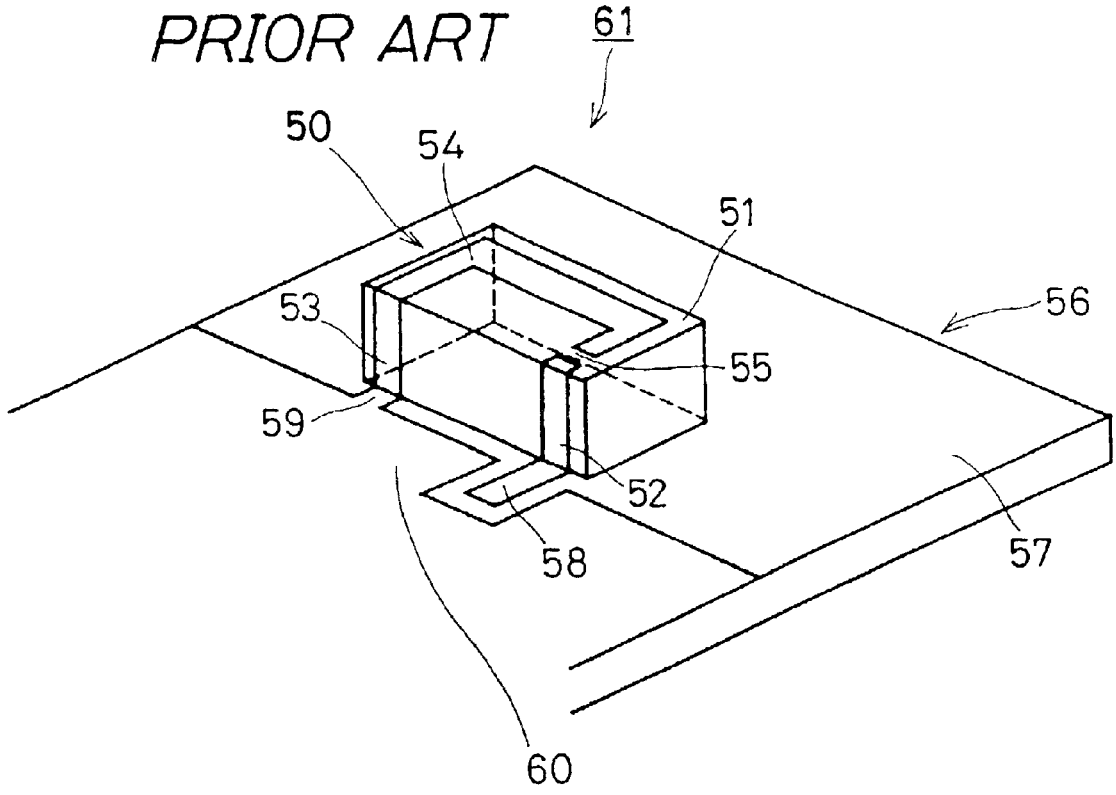
FIG. 8 PRIOR ART
FIG. 8 is a perspective view showing one example of a conventional surface-mount type antenna and an antenna apparatus incorporating the conventional antenna.

In FIG. 7, reference symbol L1 denotes an inductance of the radiating electrode 14, 34 extending helically across the surfaces of the base body 11, 31 through the ground conductor layer 20, 40, the ground electrode 19, 39, and the ground terminal 13, 33; reference symbol C2 denotes a capacitance of the radiating electrode 14, 34, which is generated mainly between the wide-area portion 15, 35 and the ground conductor layer 20, 40; and reference symbol C1 denotes a capacitance of the radiating electrode 14, 34, which is generated mainly between the wide-area portion 15, 35 and the feeding terminal 12, 32. Note that between the capacitance C1 and the ground is connected a high-frequency signal power supply. The equivalent circuit further includes a radiation resistance of the radiating electrode 14, 34 (not shown).

The radiating electrode 14, 34 of the surface-mount type antenna 10, 30 of the invention has the helically extending portion and the wide-area portion 15, 35. Therefore, the operating frequency of the antenna can be decreased by obtaining the inductance L1 and also by creating the capacitance C2 between the radiating electrode 14, 34 and the ground conductor layer 20, 40. Here, by forming the helically extending portion to realize the inductance L1, the self-inductance can be enhanced efficiently, thus achieving miniaturization of the surface-mount type antenna 10, 30. Moreover, the radiating electrode 14, 34 has its other end, where the high-frequency signal current flowing onto the conductor is few in quantity, formed into the wide-area portion 15, 35 having a larger area. This helps increase the capacitance C2 generated between the wide-area portion 15, 35 and the ground conductor layer 20, 40. Thereby, a resonant frequency, which is dependent on the inductance L1 and the capacitance C2, is decreased, thus achieving miniaturization of the surface-mount type antenna 10, 30 and the antenna apparatus 21, 41.

In the surface-mount type antenna 10, 30 and the antenna apparatus 21, 41 according to the invention, the resonant frequency of the radiating electrode 14, 34 is defined as an operating frequency of the antenna. Thus, the operating frequency of the antenna is proportional to the reciprocal of the square root of the product of the inductance L1 and the capacitance C2. It will thus be seen that an antenna of satisfactory compactness based on the surface-mount type antenna 10, 30 and the antenna apparatus 21, 41 according to the invention can be realized by increasing the inductance L1 and the capacitance C2.

As is well known, slenderizing the conductor pattern of the radiating electrode 14, 34 is effective in increasing its inductance component L1. On the basis of this fact, in the surface-mount type antenna 10, 30, the conductor pattern takes on a helical conformation to realize the desired inductance L1. This makes it possible to reduce the volume of the base body 11, 31, thus achieving miniaturization of the antenna.

On the other hand, the capacitance C2 is a capacitance component created between the ground conductor layer 20, 40 of the mounting substrate 16, 36 and the wide-area portion 15, 35 of the radiating electrode 14, 34. The capacitance value of the capacitance C2 can be increased by making the wide-area portion 15, 35 larger in area or by arranging the wide-area portion 15, 35 in proximity to the ground conductor layer 20, 40. However, in the case where the value of the capacitance C2 is increased by arranging the wide-area portion 15, 35 in proximity to the ground conductor layer 20, 40, variation in the mounting position of the surface-mount type antenna 10, 30 with respect to the mounting substrate 16, 36 significantly contributes to variation in the value of the capacitance C2. As a result, the center frequency of the antenna is undesirably varied.

Accordingly, as is achieved in the surface-mount type antenna 10, 30 of the invention and the antenna apparatus 21, 41 of the invention incorporating the antenna, it is preferable that the distance between the wide-area portion 15, 35 and the ground conductor layer 20, 40 is determined such that the influence of variation in the mounting position of the surface-mount type antenna 10, 30 with respect to the mounting substrate 16, 36 becomes negligible, and the capacitance C2 value is increased by making the wide-area portion 15, 35 larger in area.

Moreover, impedance matching between the feeding line, which is connected to the feeding electrode 18, 38 to which the feeding terminal 12, 32 is connected, and the radiating electrode 14, 34 can be achieved by adjusting the magnitude of the electromagnetic coupling. In the invention, to achieve the impedance matching, the capacitance C1 is set at an appropriate value by adjusting the configuration, area, and position of the wide-area portion 15, 35.

In the surface-mount type antenna 10, 30 of the invention, the capacitance C1 existing between the wide-area portion 15, 35 of the radiating electrode 14, 34, and the feeding terminal 12, 32 is created to adjust the impedance of the radiating electrode 14, 34 so that the radiating electrode 14, 34 is excited efficiently. The impedance of the radiating electrode 14, 34 can be adjusted by changing the capacitance C1 properly. The capacitance C1 is changed by varying an interval between the wide-area portion 15, 35 and the feeding terminal 12, 32. Also in this case, since the resonant frequency of the antenna is fixed at a certain value on the basis of the capacitance C2, it never occurs that the resonant frequency of the antenna is varied greatly with the change of the impedance of the radiating electrode 14, 34. As a result, according to the surface-mount type antenna 10, 30 and the antenna apparatus 21, 41 according to the invention, not only it is possible to achieve miniaturization, but it is also possible to attain the desired antenna characteristics as designed.

In the surface-mount type antenna 10, 30 of the invention, the base body 11, 31 is made of a dielectric or magnetic material having a substantially rectangular solid shape. For example, there is prepared a dielectric material which is predominantly composed of alumina (relative dielectric constant: 9.6). Such a material in powder form is subjected to pressure-molding and firing treatment to obtain ceramics. Using the ceramics, the base body 11, 31 is fabricated. In the alternative, the base body 11, 31 may be composed of a composite material made of ceramics, i.e. a dielectric material, and resin, or a magnetic material such as ferrite.

In a case where the base body 11, 31 is composed of a dielectric material, a high frequency signal propagates through the radiating electrode 14, 34 at a lower speed, resulting in the wavelength becoming shorter. When the relative dielectric constant of the base body 11, 31 is expressed as $\epsilon r$, the effective length of the conductor pattern of the radiating electrode 14, 34 is given as $\epsilon r^{1/2}$ times and thus the effective length is increased. Hence, where the pattern length is kept the same, the current distribution region is increased in area. This allows the radiating electrode 14, 34 to emit a larger quantity of radio waves, resulting in an advantage in enhancing the gain of the antenna.

Meanwhile, in the case of attaining the same antenna characteristics as conventional ones, the pattern length of the radiating electrode 14, 34 can be set at $1/\epsilon r^{1/2}$, thus achieving miniaturization of the surface-mount type antenna 10, 30.

Note that fabricating the base body 11, 31 using a dielectric material creates the following tendencies. If the value $\epsilon r$ is less than 3, it approaches the relative dielectric constant as observed in the air ($\epsilon r=1$). This makes it difficult to meet the demand of the market for antenna miniaturization. By contrast, if the value $\epsilon r$ exceeds 30, although miniaturization can be achieved, since the gain and the bandwidth of the antenna are proportional to the size of the antenna, the gain and the bandwidth of the antenna are sharply decreased. As a result, the antenna fails to provide satisfactory antenna characteristics. Hence, in the case of fabricating the base body 11, 31 using a dielectric material, it is preferable to use a dielectric material having a relative dielectric constant $\epsilon r$ which is kept within a range from 3 to 30. The examples of such a dielectric material include ceramic materials typified by alumina ceramics, zirconia ceramics, etc; and resin materials typified by tetrafluoroethylene, glass epoxy, etc.

On the other hand, in the case of fabricating the base body 11, 31 using a magnetic material, the radiating electrode 14, 34 has a higher impedance. This results in a low Q factor in the antenna, and the bandwidth is accordingly increased.

Fabricating the base body 11, 31 using a magnetic material creates the following tendency. If the relative magnetic permeability $\mu r$ exceeds 8, although a wider bandwidth can be achieved in the antenna, since the gain and the bandwidth of the antenna are proportional to the size of the antenna, the gain and the bandwidth of the antenna are sharply decreased. As a result, the antenna fails to provide satisfactory antenna characteristics. Hence, in the case of fabricating the base body 11, 31 using a magnetic material, it is preferable to use a magnetic material having a relative magnetic permeability $\mu r$ which is kept within a range from 1 to 8. The examples of such a magnetic material include YIG (Yttria Iron Garnet), Ni—Zr compound, and Ni—Co—Fe compound.

The radiating electrode 14, 34, the wide-area portion 15, 35, the feeding terminal 12, 32, and the ground terminal 13, 33 are each made of for example a metal material which is predominantly composed of one selected from the group consisting of aluminum, copper, nickel, silver, palladium, platinum, and gold. In order to form various patterns using the aforementioned metal materials, conductor layers having desired pattern configurations are formed on the side surface and principal surface of the base body 11, 31 by means of a conventionally-known printing method, a thin-film forming technique based on a vapor-deposition method, a sputtering method, etc., a metal foil bonding method, a plating method, or the like.

As the substrate 17, 37 constituting the mounting substrate 16, 36, an ordinary circuit substrate made of for example glass epoxy or alumina ceramics is employed.

Moreover, the feeding electrode 18, 38 and the ground electrode 19, 39 are each composed of a conductor which is employed in an ordinary circuit substrate, such as copper or silver.

The ground conductor layer 20, 40, which is arranged on one side of the surface of the mounting substrate 16, 36 with respect to the ground electrode 19, 39, is preferably composed of a conductor which is employed in an ordinary circuit substrate, such as copper or silver, and also the surface-mount type antenna 10, 30 is preferably so mounted as to protrude from an edge of the ground conductor layer 20, 40. This is desirable in terms of enhancement of the bandwidth and gain of the antenna.

Note that mounting of the surface-mount type antenna 10, 30 on the surface of the mounting substrate 16, 36, as well as connecting the feeding terminal 12, 32 and the ground terminal 13, 33 to the feeding electrode 18, 38 and the ground electrode 19, 39, respectively, is preferably achieved by soldering, for example, through a reflow furnace.

EXAMPLE

Next, a description will be given as to an example of the surface-mount type antenna and the antenna apparatus of the first embodiment according to the invention. The example is built as a 1.575 GHz-band antenna designed for GPS. In the case of using an ordinary quarter-wavelength monopole antenna, the size of the antenna element is adjusted to be approximately 47 mm in length.

In the construction of the surface-mount type antenna 10 of the first embodiment of the invention shown in FIG. 1, there is prepared a base body 11 made of alumina ceramics (dimension: 10 mm×4 mm×3 mm). Then, using a silver conductor, a 1 mm-wide conductor pattern of helical conformation is formed. The conductor pattern, like the radiating electrode 14 shown in FIG. 1, has its one end formed into a wide-area portion 15.

As the mounting substrate 16, a 0.8 mm-thick glass epoxy substrate is used. The ground conductor layer 20 has the size of 40 mm×80 mm.

The surface-mount type antenna 10 is mounted on the mounting substrate 16, thus achieving the antenna apparatus 21 of the invention. The antenna apparatus 21 is characterized by the center frequency of 1.575 GHz and the bandwidth of 30 MHz.

In a similar manner, the antenna apparatus 41 of the second embodiment of the invention as shown in FIG. 4 is fabricated. The antenna apparatus 41 is also characterized by the center frequency of 1.575 GHz and the bandwidth of 30 MHz.

It is to be understood that the application of the invention is not limited to the specific embodiments described heretofore, and that many modifications and variations of the invention are possible within the spirit and scope of the invention.

The invention may be embodied in other specific forms without departing from the spirit or essential characteristics thereof. The present embodiments are there fore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A surface-mount type antenna comprising:

a base body made of a dielectric or magnetic material having a substantially rectangular solid shape;

a feeding terminal formed at one end of one side surface of the base body;

a ground terminal formed at another end of the one side surface of the base body;

a radiating electrode which has its one end connected to the ground terminal, the radiating electrode being disposed helically across the surfaces of the base body in such a way that it extends from the one side surface, across one principal surface, another side surface which is opposite to the one side surface, and another principal surface which is opposite to the one principal surface, and then returns to the one side surface and further extends, through the one principal surface, toward the one end of the one side surface; and a wide-area portion, wherein another end of the radiating electrode extends from the one principal surface, through the other side surface, toward the other principal surface, so as to form the wide-area portion facing the feeding terminal.

2. The surface-mount type antenna of claim 1, wherein a width of the wide-area portion is adjusted to be three to ten times that of a conductor portion of the radiating electrode having a helical conformation.

3. The surface-mount type antenna of claim 1, wherein a length of the wide-area portion which lies on the other principal surface of the base body, extending from the other side surface-side to the one side surface-side, is determined such that the distance to the one side surface is equal to or greater than 1 mm.

4. The surface-mount type antenna of claim 1, wherein the base body is made of a dielectric material having a relative dielectric constant $\epsilon r$ which is kept within a range from 3 to 30.

5. The surface-mount type antenna of claim 1, wherein the base body is made of a magnetic material having a relative magnetic permeability $\mu r$ which is kept within a range from 1 to 8.

6. An antenna apparatus comprising:

a mounting substrate formed thereon a feeding electrode, a ground electrode, and a ground conductor layer which is connected to the ground electrode and arranged on one side of the mounting substrate with respect to the ground electrode; and the surface-mount type antenna of claim 1, wherein the antenna apparatus is constructed by mounting the surface-mount type antenna on the mounting substrate, with its other principal surface arranged on another side of the mounting substrate with respect to the ground electrode, and simultaneously connecting the feeding terminal and the ground terminal to the feeding electrode and the ground electrode, respectively.

7. The antenna apparatus of claim 6, wherein the surface-mount type antenna is mounted on the mounting substrate at a distance of 0.5 mm to 3 mm from an end of the ground conductor layer of the mounting substrate.

8. The antenna apparatus of claim 6, wherein the surface-mount type antenna is so mounted as to protrude from an edge of the ground conductor layer.

9. An antenna apparatus comprising:

a mounting substrate formed thereon a feeding electrode, a ground electrode, and a ground conductor layer which is connected to the ground electrode and arranged on one side of the mounting substrate with respect to the ground electrode; and the surface-mount type antenna of claim 1, wherein the antenna apparatus is constructed by mounting the surface-mount type antenna on the mounting substrate, with its one principal surface arranged on another side of the mounting substrate with respect to the ground electrode, and simultaneously connecting the feeding terminal and the ground terminal to the feeding electrode and the ground electrode, respectively.

10. The antenna apparatus of claim 9, wherein the surface-mount type antenna is mounted on the mounting substrate at a distance of 0.5 mm to 3 mm from an end of the ground conductor layer of the mounting substrate.

11. The antenna apparatus of claim 9, wherein the surface-mount type antenna is so mounted as to protrude from an edge of the ground conductor layer.

* * * * *